US006611105B1

(12) United States Patent
Chiu

(10) Patent No.: US 6,611,105 B1
(45) Date of Patent: Aug. 26, 2003

(54) ELECTRIC BULB STRUCTURE

(76) Inventor: Yu-Sheng Chiu, No. 21, Lane 37, Dungshing Rd., Toufen Jen, Miaoli (TW)

( * ) Notice: Subject to any disclaimer, the term of this patent is extended or adjusted under 35 U.S.C. 154(b) by 0 days.

(21) Appl. No.: 10/095,045

(22) Filed: Mar. 12, 2002

(51) Int. Cl.[7] ..... H01J 13/46; H01J 1/88; F21K 2/00

(52) U.S. Cl. ..... 315/69; 315/58; 315/66; 315/64; 315/56; 313/272; 313/279; 313/271; 362/211

(58) Field of Search ..... 315/69, 66, 64, 315/68, 56, 46, 49, 58; 313/271, 272–279, 316; 362/211

(56) References Cited

U.S. PATENT DOCUMENTS 3,638,068 A * 1/1972 Wilson ..... 315/67
3,817,591 A * 6/1974 Deiss ..... 445/6
3,916,249 A * 10/1975 Ackermann ..... 315/73
5,132,594 A * 7/1992 Nilssen ..... 315/88
6,017,838 A * 1/2000 Marlor ..... 501/70
6,316,878 B1 * 11/2001 Tsukada ..... 315/73

* cited by examiner

*Primary Examiner*—Don Wong
*Assistant Examiner*—Tuyet T. Vo
(74) *Attorney, Agent, or Firm*—Rosenberg, Klein & Lee

(57) ABSTRACT

An electric bulb structure includes a housing, a base post extended into an inside of the housing from one end of the housing, a shade mounted on an opening of the housing, a first conductive wire and a second conductive wire each extended into the inside of the housing from an outside of the housing and each extended through the base post, a first filament having a first end connected to the first conductive wire, a second filament having a first end connected to the second conductive wire, and a third conductive wire having a first end connected to a second end of the first filament, and a second end connected to a second end of the second filament.

5 Claims, 6 Drawing Sheets

ELECTRIC BULB STRUCTURE

BACKGROUND OF THE INVENTION

1. Field of the Invention

The present invention relates to an electric bulb structure, and more particularly to an electric bulb structure, wherein the third conductive wire is mounted in the inside of the housing, and is directly connected to the first filament and the second filament, without having connect the conductive wires outside of the housing. By such an arrangement, assembly of the shade and the housing is more rapid, thereby efficiently saving the assembly time and reducing the use of material.

2. Description of the Related Art

A conventional electric bulb structure in accordance with the prior art shown in FIGS. 1 and 2 comprises a housing 10, a base post 11 extended into the inside of the housing 10 from one end of the housing 10, and a shade 20 mounted on the outside of the housing 10 to seal the base post 11. The conventional electric bulb structure further comprises a first conductive wire 12, a second conductive wire 13, a third conductive wire 14, and a fourth conductive wire 15 each extended into the housing 10 from the outside of the housing 10 and each extended through the base post 11. A first filament 16 is mounted in the inside of the housing 10 to connect the first conductive wire 12 and the third conductive wire 14. A second filament 17 is mounted in the inside of the housing 10 to connect the second conductive wire 13 and the fourth conductive wire 15.

As shown in FIG. 2, the first conductive wire 12 and the second conductive wire 13 are respectively connected to the contact points 21 and 22 on the top of the shade 20, and the third conductive wire 14 and the fourth conductive wire 15 are connected with each other and are soldered on a combination portion 23 of the shade 20 and the housing 10, thereby forming an 6 electric circuit. Thus, when the shade 20 is mounted on a lamp seat and is energized, the electric bulb may be lighted.

However, the third conductive wire 14 and the fourth conductive wire 15 have to be connected in the outside of the housing 10, thereby causing inconvenience in the working process. In addition, the third conductive wire 14 and the fourth conductive wire 15 have to extend outward from the housing 10 from the inside of the housing 10, thereby increasing the cost of fabrication.

SUMMARY OF THE INVENTION

The present invention has arisen to mitigate and/or, obviate the disadvantage of the conventional electric bulb structure.

The primary objective of the present invention is to provide an electric bulb structure, wherein the third conductive wire is mounted in the inside of the housing, and is directly connected to the first filament and the second filament, without having connect the conductive wires outside of the housing. By such an arrangement, assembly of the shade and the housing is more rapid, thereby efficiently saving the assembly time and reducing the use of material.

In accordance with the present invention, there is provided an electric bulb structure, comprising:

a housing;

a base post extended into an inside of the housing from one end of the housing;

a shade mounted on an opening of the housing;

a first conductive wire extended into the inside of the housing from an outside of the housing and extended through the base post;

a second conductive wire extended into the inside of the housing from an outside of the housing and extended through the base post;

a first filament having a first end connected to the first conductive wire;

a second filament having a first end connected to the second conductive wire; and a third conductive wire having a first end connected to a second end of the first filament, and a second end connected to a second end of the second filament.

Preferably, the shade is provided with a first contact point connected to the first conductive wire, and a second contact point connected to the second conductive wire.

Preferably, the shade is provided with a contact point connected to the second conductive wire, and the first conductive wire is connected to a combination portion of the shade and the housing.

Further benefits and advantages of the present invention will become apparent after a careful reading of the detailed description with appropriate reference to the accompanying drawings.

DETAILED DESCRIPTION OF THE INVENTION

Figure 3:
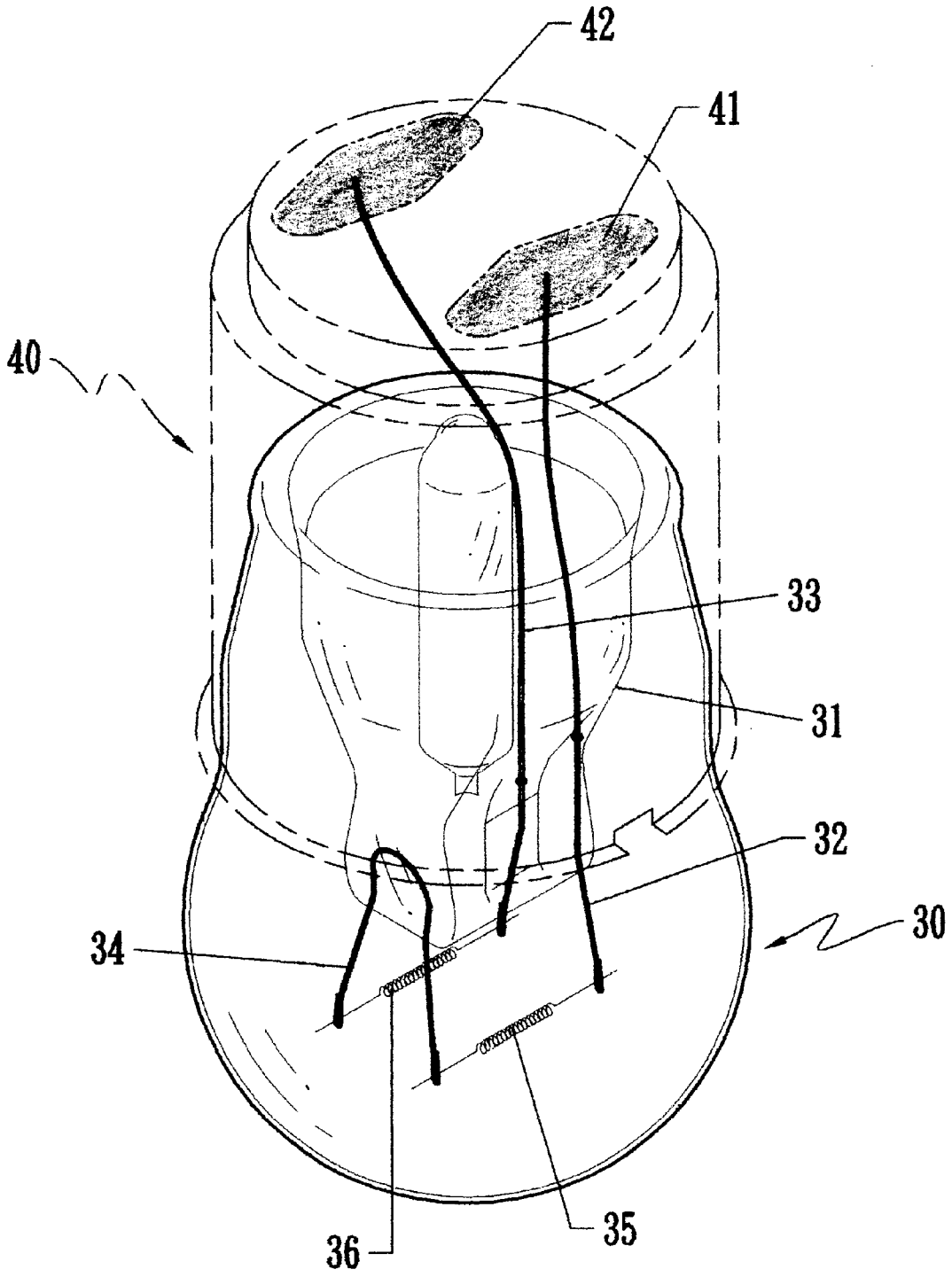
FIG. 3 is a perspective view of an electric bulb structure in accordance with a first embodiment of the present invention.
Figure 4:
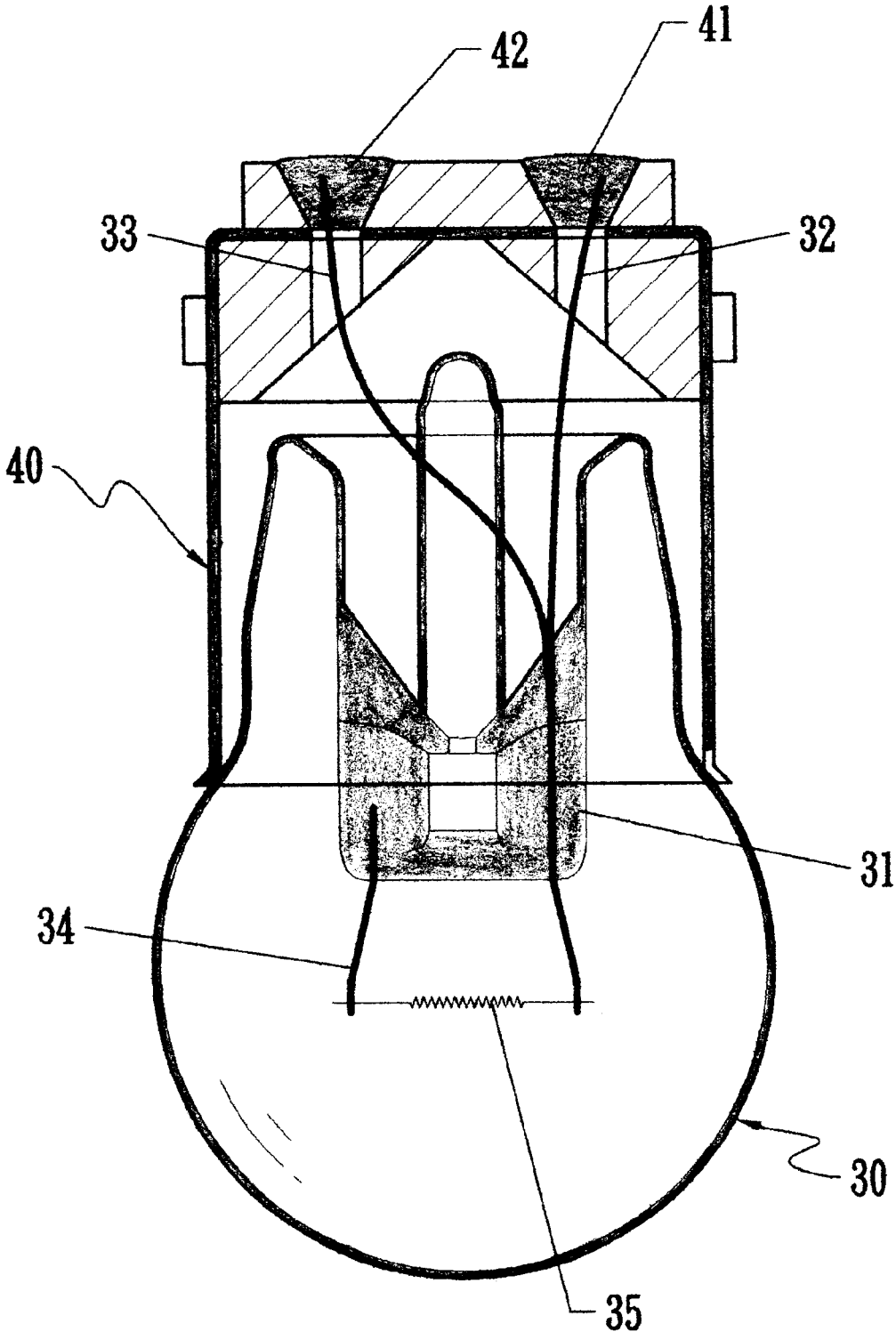
FIG. 4 is a side plan cross-sectional view of the electric bulb structure as shown in FIG. 3.

Referring to the drawings and initially to FIGS. 3 and 4, an electric bulb structure in accordance with a first embodiment of the present invention comprises a housing 30, a base post 31 extended into the inside of the housing 30 from one end of the housing 30, and a shade 40 mounted on an opening of the housing 30 to close and seal the base post 31.

The shade 40 is provided with a first contact point 41, and a second contact point 42.

The electric bulb structure further comprises a first conductive wire 32 and a second conductive wire 33 each extended into an inside of the housing 30 from an outside of the housing 30 and each extended through the base post 31. The first conductive wire 32 has a first end connected to a first end of a first filament 35 and a second end connected to the first contact point 41 of the shade 40. The second conductive wire 33 has a first end connected to a first end of a second filament 36 and a second end connected to the first contact point 42 of the shade 40.

The electric bulb structure further comprises a third conductive wire 34 having a first end connected to a second end of the first filament 35, and a second end connected to a second end of the second filament 36.

Figure 1:
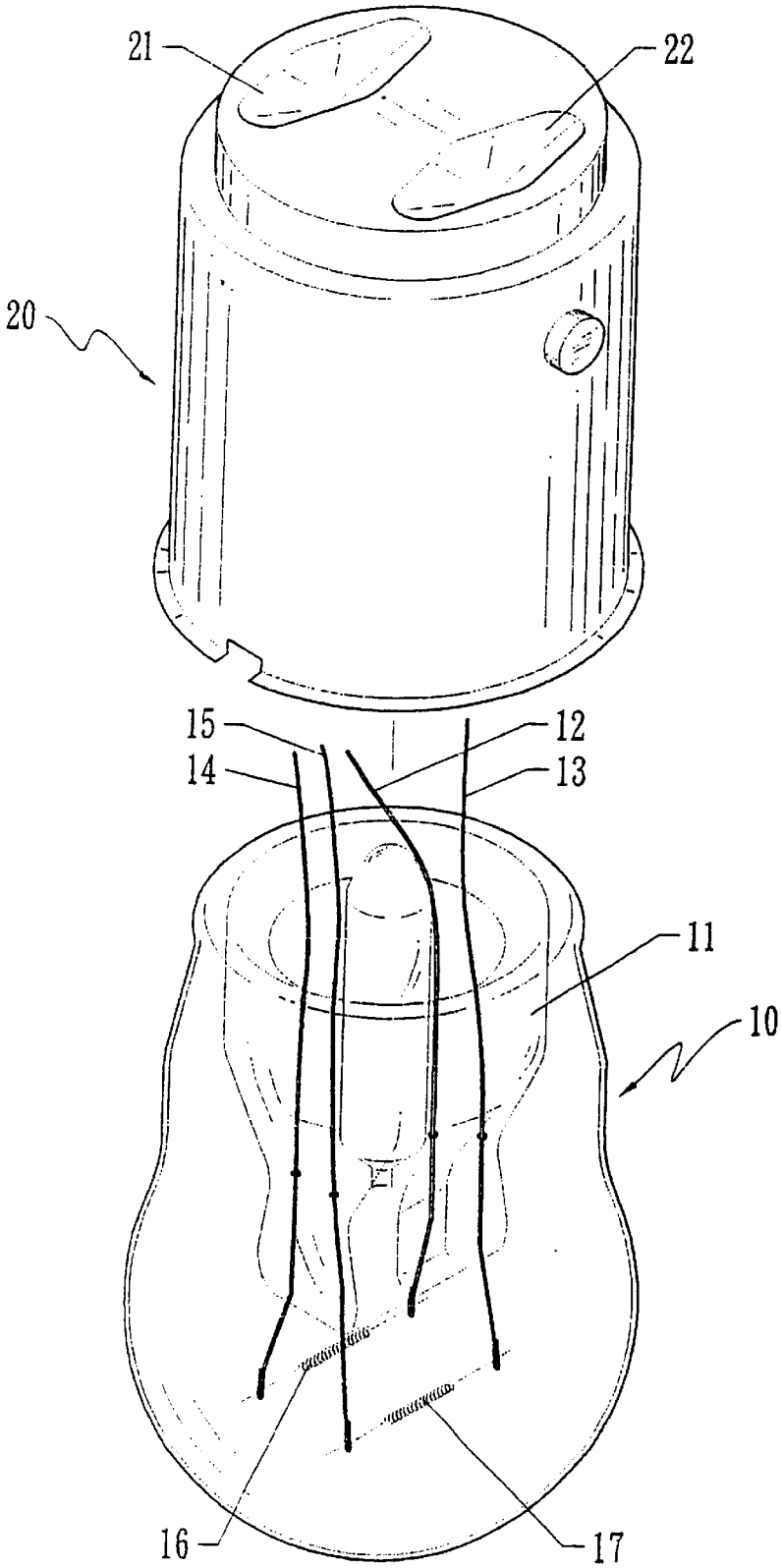
FIG. 1 PRIOR ART
FIG. 1 is an exploded perspective view of a conventional electric bulb structure in accordance with the prior art.
Figure 2:
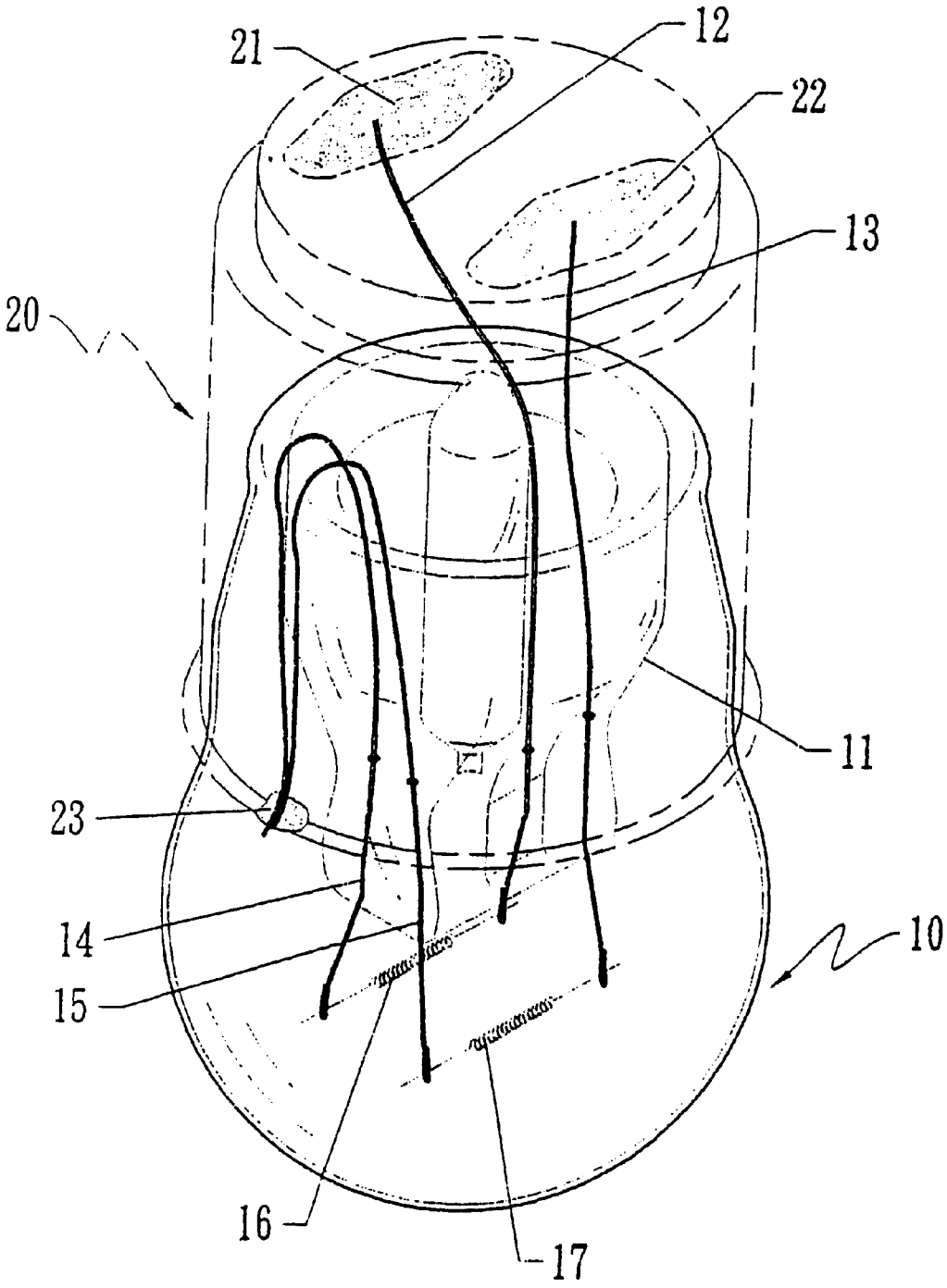
FIG. 2 PRIOR ART
FIG. 2 is a perspective assembly view of a conventional electric bulb structure in accordance with the prior art.

As shown in FIG. 4, the third conductive wire 34 is directly connected to the first filament 35 and the second filament 36 in the inside of the housing 30. By such an arrangement, assembly of the shade 40 and the housing 30 is more rapid, thereby efficiently saving the assembly time and reducing the use of material, without having to provide the fourth conductive wire as disclosed in the conventional electric bulb structure in accordance with the prior art shown in FIGS. 1 and 2.

In comparison, the conventional electric bulb structure in accordance with the prior art as shown in FIGS. I and 2 has to provide four conductive wires mounted on the two ends of the two filaments respectively, wherein two of the four conductive wires have to be connected in the outside of the housing, thereby greatly causing inconvenience in the working and assembling process.

Figure 5:
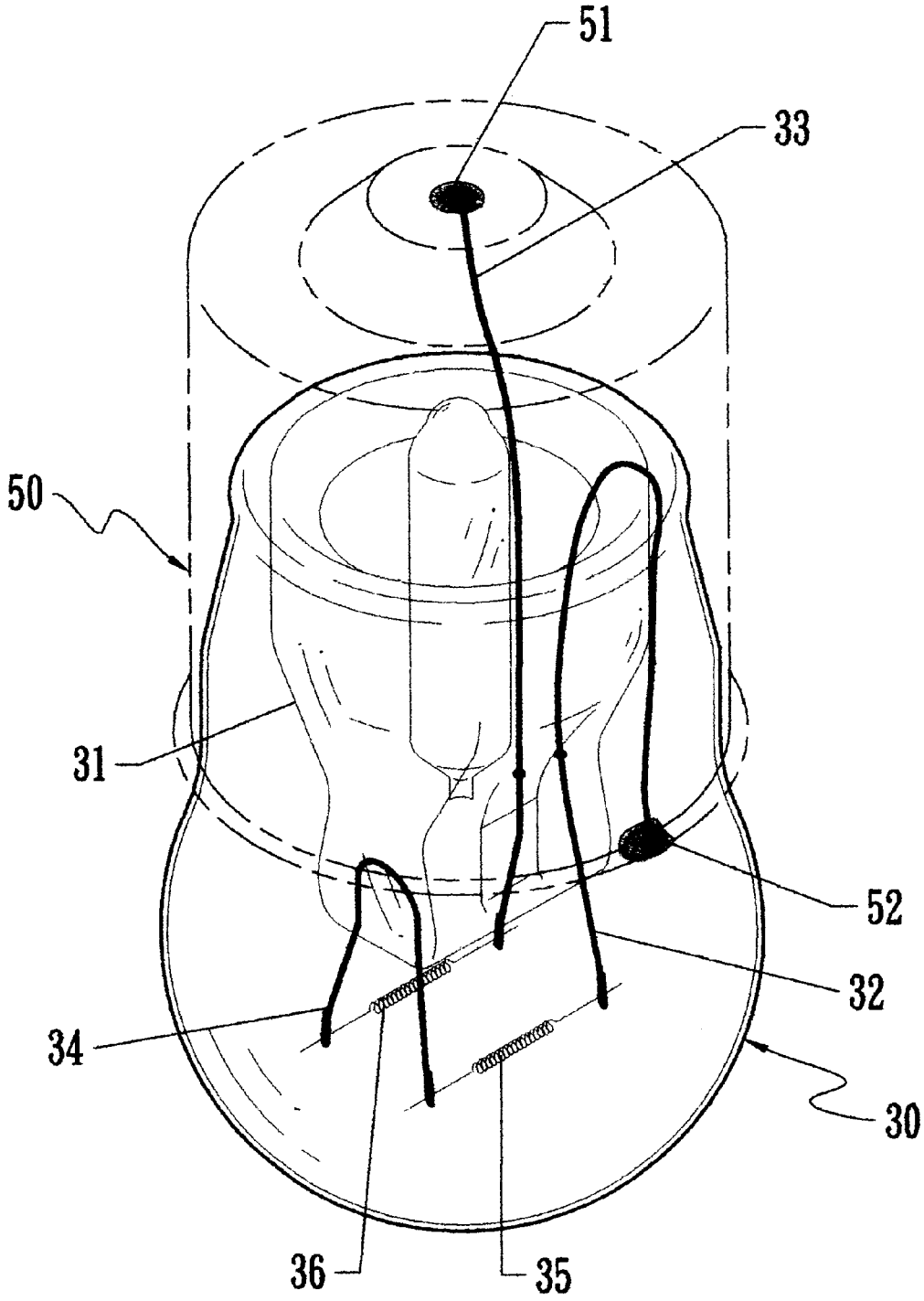
FIG. 5 is a perspective view of an electric bulb structure in accordance with a second embodiment of the present invention.
Figure 6:
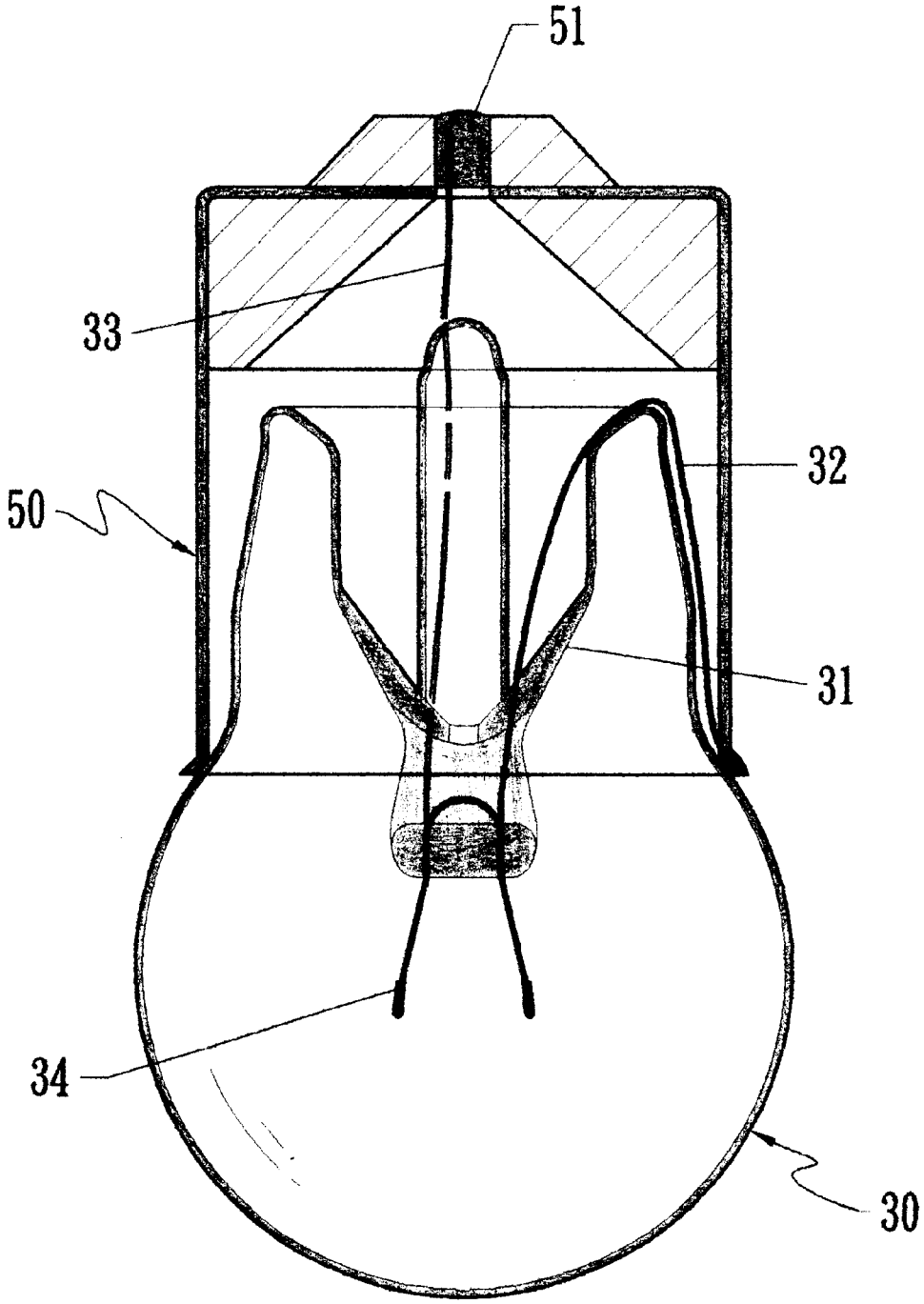
FIG. 6 is a side plan cross-sectional view of the electric bulb structure as shown in FIG. 5.

Referring to FIGS. 5 and 6, an electric bulb structure in accordance with a second embodiment of the present invention comprises a shade 50 mounted on the opening of the housing. 30 to close and seal the base post 31. The shade 50 has a contact point 51. The first conductive wire 32 has a first end connected to the first end of the first filament 35 and a second end connected to a combination portion 52 of the shade 50 and the housing 10. The second conductive wire 33 has a first end connected to the first end of the second filament 36 and a second end connected to the contact point 51 of the shade 50.

Accordingly, in the electric bulb structure in accordance with the present invention, the third conductive wire 34 is mounted in the inside of the housing 30, and is directly connected to the first filament 35 and the second filament 36, without having connect the conductive wires outside of the housing 30. By such an arrangement, assembly of the shade 40 and the housing 30 is more rapid, thereby efficiently saving the assembly time and reducing the use of material.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. An electric bulb structure, comprising:

a housing defining an inner compartment extending inward from an open end;

a base post extending into the inner, compartment of the housing from the open end of the housing;

a shade mounted on the open end of the housing;

a first conductive wire extending through the base post into the inner compartment of the housing from outside the housing;

a second conductive wire extending through the base post into the inner compartment of the housing from outside the housing;

a first filament having a first end connected to the first conductive wire;

a second filament having a first end connected to the second conductive wire; and, a third conductive wire having first and second ends both disposed within the inner compartment and an intermediate portion extending contiguously therebetween, the first end being connected to a second end of the first filament, and the second end being connected to a second end of the second filament.

2. The electric bulb structure in accordance with claim 1, wherein the shade is provided with a first contact point connected to the first conductive wire, and a second contact point connected to the second conductive wire.

3. The electric bulb structure in accordance with claim 1, wherein the shade is provided with a contact point connected to the second conductive wire, and the first conductive wire is connected to a combination portion of the shade and the housing.

4. The electric bulb structure in accordance with claim 1 wherein the intermediate portion of the third conductive wire extends between the first and second ends thereof through the base post.

5. The electric bulb structure in accordance with claim 1 wherein the intermediate portion of the third conductive wire is integrally formed with the first and second ends thereof.

* * * * *